US010101025B2

(12) United States Patent
Berhaut et al.

(10) Patent No.: US 10,101,025 B2
(45) Date of Patent: Oct. 16, 2018

(54) METHOD AND COMBUSTING FUEL AND BURNER THEREFOR

(71) Applicant: L'Air Liquide, Societe Anonyme pour l'Etude et l'Exploitation des Procedes Georges Claude, Paris (FR)

(72) Inventors: Paul Berhaut, Versailles (FR); Benoit Grand, Versailles (FR); Jacky Laurent, Saint-Cry l'Ecole (FR); Jacques Mulon, Massy (FR); Xavier Paubel, Montigny le Bretonneux (FR); Patrick Recourt, Marcoussis (FR); Remi Pierre Tsiava, Saint Germain-les-Corbeil (FR)

(73) Assignee: L'Air Liquide Societe Anonyme Pour L'Etude Et L'Exploitation Des Procedes Georges Claude, Paris (FR)

( * ) Notice: Subject to any disclaimer, the term of this patent is extended or adjusted under 35 U.S.C. 154(b) by 431 days.

(21) Appl. No.: 14/654,284

(22) PCT Filed: Dec. 18, 2013

(86) PCT No.: PCT/EP2013/077195
§ 371 (c)(1),
(2) Date: Jun. 19, 2015

(87) PCT Pub. No.: WO2014/096072
PCT Pub. Date: Jun. 26, 2014

(65) Prior Publication Data

US 2015/0330624 A1 Nov. 19, 2015

(30) Foreign Application Priority Data

Dec. 19, 2012 (EP) ..... 12306624.3

(51) Int. Cl.
*F23D 14/22* (2006.01)
*F23D 1/04* (2006.01)
(Continued)

(52) U.S. Cl.
CPC ..... *F23D 1/04* (2013.01); *F23D 14/16* (2013.01); *F23D 14/22* (2013.01); *F23D 14/32* (2013.01);
(Continued)

(58) Field of Classification Search
CPC . F23D 1/04; F23D 14/22; F23D 14/32; F23D 14/16; F23D 14/64; F23D 14/70;
(Continued)

(56) References Cited

U.S. PATENT DOCUMENTS 4,622,007 A 11/1986 Gitman
5,554,022 A 9/1996 Nabors et al.
(Continued)

OTHER PUBLICATIONS

International Search Report for PCT/EP2013/077195, dated Jan. 28, 2014.

*Primary Examiner* — Alfred Basichas
(74) *Attorney, Agent, or Firm* — Christopher J. Cronin

(57) ABSTRACT

Method and burner for combusting a main fuel with a main oxidizer, whereby flows of the main fuel and the main oxidizer are injected via an injector end, comprising at least one metallic injector, said injector end being positioned in the upstream section of a main passage of a refractory block and whereby multiple jets are injected into the downstream section of the main passage to increase mixing and turbulence of the flows of the main fuel and the main oxidizer.

15 Claims, 4 Drawing Sheets

(51) Int. Cl.

| | |
|---|---|
| ***F23D 14/16*** | (2006.01) |
| ***F23D 14/64*** | (2006.01) |
| ***F23D 14/70*** | (2006.01) |
| ***F23D 14/32*** | (2006.01) |

(52) U.S. Cl.
CPC ..... *F23D 14/64* (2013.01); *F23D 14/70* (2013.01); *F23D 2203/101* (2013.01); *F23D 2212/10* (2013.01); *F23D 2212/20* (2013.01); *F23D 2900/00006* (2013.01); *F23L 2900/07002* (2013.01); *F23M 2900/05021* (2013.01)

(58) Field of Classification Search
CPC ..... F23D 2900/00006; F23D 2212/20; F23D 2203/101; F23D 2212/10; F23L 2900/07002; F23M 2900/05021
See application file for complete search history.

(56) References Cited

U.S. PATENT DOCUMENTS

| | | | |
|---|---|---|---|
| 2007/0037106 | A1 | 2/2007 | Kobayashi et al. |
| 2009/0220900 | A1 | 9/2009 | Kobayashi et al. |

METHOD AND COMBUSTING FUEL AND BURNER THEREFOR

CROSS-REFERENCE TO RELATED APPLICATIONS

This application is a § 371 of International PCT Application PCT/EP2013/077195, filed Dec. 18, 2013, which claims § 119(a) foreign priority to EP patent application 12306624.3, filed Dec. 19, 2012.

BACKGROUND

FIELD OF THE INVENTION

The present invention relates to a burner and use thereof, in particular in an industrial furnace.

Related Art

Many industrial furnaces, which are heated by combustion of fuel with oxidizer, operate at very high temperatures. Some also operate at high pressures.

Many of the burners used to combust fuel with oxidizer comprise non-refractory metallic injectors for the injection of fuel and oxidizer into a combustion zone.

When the metallic injectors are subjected to high temperatures or to high temperature gradients, their operating time (lifespan) may be substantially reduced. This leads to additional costs and even additional furnace down time for the furnace operator.

In order to protect metallic injectors against overheating due to the high temperatures in the furnace combustion zone and heat radiation from said zone, it is known to equip a burner with a refractory ceramic burner block, which, in use, is integrated in a wall of the furnace surrounding the combustion zone, and to recess the metallic injectors with respect to the furnace combustion zone in a through passage provided in said burner block. Said through passage thus comprises an upstream section surrounding the one or more metallic injectors and a downstream section downstream of the one or more metallic injectors. In this manner, the metallic injectors are partially shielded from the high temperature in and the heat radiation from the combustion zone.

In order to limit the heat radiation from the combustion zone which may reach the metallic injectors via the downstream section of the passage, the opening of said downstream section facing the furnace combustion zone must not be excessive.

It is, moreover, often desirable to restrict or avoid recirculation of the combustion atmosphere into the burner block towards the metallic injectors, in particular when said atmosphere contains condensable and/or corrosive pollutants and/or abrasive solids. This is a further reason for restricting the opening of the downstream section of the through passage.

The need to recess the metallic injectors in the burner block may, without additional measures, lead to insufficient mixing of fuel and oxidizer within the through passage, thereby reducing the efficiency of the combustion process.

Such insufficient mixing may result in excessively long flames and/or insufficient combustion of the fuel with the oxidizer. It may also lead to a detached and unstable flame.

As a consequence, it is known in the art to position mixing devices such as swirlers and vanes inside injectors or passages in order to promote mixing of fuel and oxidizer. However, such devices increase the solid angle of the jets injected by the metallic injectors, requiring in turn to increase the width of the downstream section so as to avoid a detrimental impact between the jets and the refractory surface of the downstream section, thereby increasing heat radiation from the combustion zone to the metallic injectors, increasing the risk of thermal damage to the metallic injectors and to the mixing device and also increasing the risk of atmosphere recirculation into the passage.

Due to the abrasive nature of particulate solid fuels, the use of mixing devices in injectors or passages transporting solid fuels is also not an option in industrial burners. Mixing devices may likewise not be suited for injectors or passages transporting liquid fuels.

SUMMARY OF THE INVENTION

It is an aim of the present invention at least in part to overcome the above problems with the prior art.

In accordance with the present invention, there is provided a method of combusting fuel with oxidizer by means of a burner comprising a main injector assembly and a refractory burner block. The main injector assembly terminates in an injection end which comprises at least one metallic injector for the injection of fuel and/or oxidizer. For reasons of costs and ease of production (machinability), the metallic injectors are usually made of non-refractory metal, though, for safety reasons, they may also may be made of refractory metal.

The refractory burner block comprises a main passage which extends along a longitudinal axis from a cold face of the block to a hot face of the block opposite the cold face and defines a main injection direction X. In the present context, the term "hot face" refers to the face of the burner block which is intended to be directed towards the combustion zone when the burner is installed in the furnace, and through which fuel and oxidizer is injected into the combustion zone. The "cold face" of the burner block, on the other hand, refers to the face of the burner block opposite the "hot face" which, when the burner is installed in the furnace, faces away from the combustion zone.

The main passage of the refractory burner block is bordered by a surrounding surface of refractory material.

The main passage has an upstream section adjacent the cold face and a downstream section located downstream of the upstream section and adjacent the hot face. The downstream section terminates in a main injection opening in the hot face of the block.

Said downstream section may have a larger cross section than the upstream section of the main passage. It is to be noted that the cross section of the downstream section of the main passage, (which cross section is per definition perpendicular to the longitudinal axis), may be constant or variable.

The injection end of the main injector assembly is positioned in the upstream end of the main passage so that the upstream section surrounds the at least one metallic injector.

By means of the injector end of the main injector assembly, a flow of main fuel and a flow of main oxidizer are injected towards and into the downstream end of the main passage.

According to the invention, the burner block further comprises multiple auxiliary passages terminating in the downstream section via n auxiliary openings in the surrounding surface of the main passage, whereby n is at least 2. n Jets of agitating gas are injected into the downstream section via the n auxiliary openings so as to interact with the flow of main fuel and the flow of main oxidizer and to increase turbulence and mixing of the flows of main fuel and of main oxidizer.

From US2009/0220900 there is known a method of combustion using a burner having a burner body and a burner block. The burner block comprises, in that order and in coaxial configuration, a first passageway extending through the block. Said first passageway comprises a barrel segment that extends into the block from the rear surface of the block, a throat segment, a tapered segment and a port segment extending to the front face of the block. The burner body comprises a first, a second and a third tube extending from the rear surface of the block and having parallel or coaxial axes and through which fuel and gases can be injected. The first, second and third tube terminate respectively in a first tube end, in a second tube end in and a third tube end located inside the passageway upstream of or inside the throat segment. A plurality of secondary passageways also extend through the burner block from inlet openings in the rear surface of the block to discharge openings in the front surface of the block. Each secondary passageway has an axis at its discharge opening in the front surface of the block which converges to the axis of the first passageway, diverges from the axis of the first passageway or is parallel to the axis of the first passageway. Any contact, between the fluids injected through the secondary passageways with fluids injected through the burner body therefore cannot occur inside the first passageway, but only downstream of the burner, so that turbulence or mixing of the fluids injected by the burner body inside the passageway is not influenced, let alone increased, by the fluid injected through the secondary passageways.

U.S. Pat. No. 4,622,007 describes a hydrocarbon fluid fuel burner comprising an upstream fuel and oxidant supply assembly and a liquid-cooled combustion located downstream of the supply assembly. Passages are provided through the burner block to receive hydrocarbon fuel, a first and a second oxidant from the supply assembly and to transport said fuel and oxygen from the outlet of the supply assembly to a combustion chamber located inside the burner block. A first oxidizing gas is thus directed in a jet along the central axis of the combustion chamber, the hydrocarbon fuel is directed into said combustion chamber in a plurality of jets a around the central jet so as to mix with the first oxidizing gas to stabilize combustion within the combustion chamber. A second oxidizing gas, having a different oxygen concentration from the first oxidizing gas, is directed into the combustion to mix with the hydrocarbon fuel in the flame core and to mix with the hydrocarbon fuel outside said combustion chamber to create a final flame pattern.

By using, according to the present invention, at least one agitating gas jet injected into the downstream section of the passage to increase mixing of the main fuel with the main oxidizer, the present invention makes it possible to achieve efficient combustion of the main fuel with the main oxidizer with a limited flame length using a burner comprising a metallic injector assembly of which the injection end is recessed within a burner block so as to protect it against the high temperatures and heat radiation from the combustion zone and while keeping recirculation of the furnace atmosphere into the passage under control.

In many instances this can be achieved without the use of mixing devices as described above, although the use of mixing devices is not excluded, for example in a passage or injector for injecting a flow of main oxidizer.

By thus reducing the reliance on mixing devices, the solid angle of the injected jet(s) downstream of the metallic injector(s) can be kept within acceptable limits.

When it is desired to restrict the flame length, i.e. to restrict the distance from the burner over which combustion of fuel with oxidizer takes place, the agitating gas jets are injected so as to decrease the momentum of the flow of main fuel and the flow of main oxidizer in the main injection direction X. The n agitating gas jets then slow down the flows of the main fuel and main oxidizer in said direction X so as to allow a more complete combustion of the main fuel with the main oxidizer over a shorter distance, i.e. length, in the combustion zone from the burner hot face measured in the direction X. In this manner, the flow of main fuel and the flow of main oxidizer can be injected with a high momentum while ensuring a sufficient degree of combustion of the main fuel with the main oxidizer within a predetermined flame length.

According to a preferred embodiment, the n jets of agitating gas are injected so as not to deviate the flame, i.e. so as not to change the propagation direction of the flame compared to the propagation direction of the flame without the n jets of agitating gas.

This is achieved by an appropriate selection of the number n of agitating gas jets, the position of the n auxiliary openings around the axis of the main passage, the flow rates of the agitating gas jets, their velocity, etc.

The n auxiliary openings of said multiple auxiliary passages are preferably positioned in axial symmetry around the axis, i.e. the n auxiliary openings are evenly distributed around the axis so as to maximize the coverage of the flows of main fuel and main oxidizer by the n agitating gas jets.

As the n jets of agitating gas are injected into the downstream section of the main passage so as to interact with the flow of main fuel and the flow of main oxidizer and thereby to increase the turbulence and mixing of the flows of main fuel and of main oxidizer, the n jets of agitating gas are injected with an injection direction and a velocity permitting such an effect. In particular, in order to increase turbulence and mixing of the flows of main fuel and of main oxidizer, the agitating gas jets are injected in a direction so as to impact said flows and with a sufficient injection velocity so as to penetrate into the flows of main fuel and main oxidizer.

The agitating gas jets may, in particular, be injected in a direction towards the longitudinal axis.

The agitating gas jets may also be injected in a direction which does not lie within the plane defined by the auxiliary opening of the agitating gas jet and the axis.

In the latter case, the interaction between the agitating gas jet and the flows of main fuel and main oxidizer may cause or reinforce a swirling movement of said flows around the axis in the sense of rotation defined by the agitating gas jet. In this manner, not only is the mixing of the main fuel with the main oxidizer improved, but the residence time of the main fuel within the flow of main oxidizer is also increased whereby both effects improve the efficiency of the combustion of the main fuel with the main oxidizer.

The n agitating gas jets may be injected according to a same sense of rotation around the axis i.e. n agitating gas jets may be injected clockwise around the axis as seen from the hot face side, so that the combined effect of the n agitating jets reinforces a clockwise rotation of the main fuel and the main oxidizer around the axis Alternatively, the n agitating gas jets may be injected counterclockwise around the axis. In these cases and in order to enhance the momentum reducing effects of the agitating gas jets, they are usefully injected in an injection direction having a vector component towards the axis (as opposed to an injection direction perpendicular to the plane defined by the axis and the corresponding auxiliary opening). When different agitating gas jets are injected in opposing senses of rotation around the axis, the effect rotation of the main fuel and the main oxidizer around the axis is not reinforced, but turbulence is nevertheless increased.

The downstream section may have a greater cross section than the upstream section. Such an embodiment may be useful to limit any impact of the flows of main fuel and main oxidizer injected by the at least one metallic injector with the refractory material of the block, which may lead to corrosion and/or erosion of the surface of the through passage downstream of the at least one metallic injector. When combustion of the main fuel with the main oxidizer starts inside the through passage, such a wider section likewise substantially limits potentially damaging impact of the flame on the refractory surface of the through passage.

The cross section of the downstream section may be constant or variable.

When the cross section of the downstream section is wider and variable, it generally increases towards the hot face of the block.

Alternatively, the downstream section may present a narrowing near or at the hot face of the bloc, thereby providing additional thermal shielding of the at least one metallic injector against radiation from the combustion zone of the furnace. When the n auxiliary openings are located within the narrowing of the downstream section, the impact of the n agitating gas jets onto the flows of main fuel and main oxidizer takes place in a restricted volume, which can reinforce the effect of the agitating gas jets on said flows.

Depending on the nature and goal of the combustion process, different gases may be used as agitating gas.

The number of auxiliary openings may in practice be restricted by the circumference of the downstream section and/or by manufacturing costs. For these reasons, the number n of auxiliary openings will normally not exceed 12, preferably not exceed 10. Preferably, n is at least 3, more preferably at least 4, at least 5 or at least 6.

Different angles between the injection direction of the agitating gas jets and the main injection direction X are possible.

The angle between the injection direction of the agitating gas jets and the main injection direction is typically from 30° to 105°, preferably from 45° to 105°.

When one seeks to reduce the momentum of the flows of main oxidizer and main fuel in flow direction X, for example in order to increase the residence time of the main fuel in the flame, the n agitating gas jets should not be injected principally in said main flow direction X. It is then preferred to inject the agitating gas jets according to injection directions which form an angle of between 60° and 105° with the main injection direction X, preferably between 65° and 85°.

The refractory block may be a refractory ceramic block. The refractory block may also be a metallic refractory block.

According to a first embodiment, the agitating gas is a substantially inert gas. In the present context, an "inert gas" is a gas which does not participate in the combustion process. A "substantially inert gas" is a gas which consists for more than 75% vol of inert gas, preferably for more than 85% vol. Examples of inert gases suitable for use as agitating gas are steam, $CO_2$, and recycled combustion gas. In the latter case, combustion gas from the combustion zone of the furnace may be injected as agitating gas with or without treatments such as dedusting, vapour condensation, etc.

Alternatively, a secondary oxidizer may be used as agitating gas. Said secondary oxidizer may be identical to the main oxidizer or may differ from the main oxidizer. In the latter case, the secondary oxidizer may, in particular, have a higher oxygen content than the main oxidizer, for example so as to ensure substantially complete combustion of the main fuel. In that case, the secondary oxidizer advantageously has an oxygen content of at least 50% vol, preferably of at least 80% vol and more preferably of at least 90% vol, and at most 100% vol.

The agitating gas may also be a secondary fuel. The secondary fuel may be the same as or differ from the main fuel. For certain applications, it is preferable to choose a secondary fuel with a higher calorific value than the main fuel. This is in particular useful when the main fuel is difficult to burn or to burn completely. For example, the main fuel may be a heavy petroleum fraction, combustible liquid waste, particulate solid waste, particulate solid carbonaceous fuel, etc., and the agitating gas may be a gaseous fuel such as methane, propane, natural gas, etc. Examples of particulate solid carbonaceous fuels are solid fossil carbonaceous fuels and solid biomass.

When the main fuel is a particulate solid fuel, it may be injected in the form of a slurry, for example a slurry of particulate solid fuel in water. Alternatively, the particulate solid fuel may also be injected in the form of a gas-entrained solid fuel.

Different configurations may be used for injecting the main fuel and the main oxidizer into the downstream section of the main passage.

According to one embodiment, the main fuel or at least part of the main fuel is injected around the main oxidizer. This embodiment may be of interest for partial combustion processes in which one seeks to avoid or limit contact between the main oxidizer and the partial combustion products in the furnace atmosphere within the combustion zone. In that case, the agitating gas is preferably not an oxidizer. An interesting example of a partial combustion method of the invention is one where the main fuel is partially combusted so as to generate producer gas. Such producer gas, which contains significant amounts of CO and $H_2$, may find useful application as a starting product for chemical synthesis processes or as an alternative fuel in downstream combustion process.

The main oxidizer may also, in total or in part, be injected around the main fuel. This embodiment may be of interest for combustion processes whereby complete combustion of the main fuel is desired.

Other configurations may also be envisaged. For example, the main injector assembly may comprise multiple main fuel injectors and/or multiple main oxidizer injectors.

According to a preferred embodiment of the invention, the main fuel and the main oxidizer are injected in a concentric manner In order to improve contact and mixing of the main fuel with the main oxidizer, the inner injector may widen slightly towards the end (for example at an angle of at most 12° with the main injection direction X). For the same purpose, the outer injector may be made to narrow slightly towards its injection end. Alternatively, the inner and/or the outer injector may have a constant cross section towards its/their injection end(s).

The present invention also relates to burners adapted for use in the above-described combustion method. Such a burner comprises a metallic main injector assembly and a refractory burner block. The injector assembly terminates in an injection end which comprises at least one metallic injector for injecting fuel and oxidizer. The burner block comprises a main passage extending along a longitudinal axis from a cold face of the block to a hot face of the block opposite the cold face and defining a main injection direction X. The main passage is bordered by a surrounding surface of refractory material. The main passage has an upstream section adjacent the cold face and a downstream section adjacent the hot face and downstream of the upstream section. The injection end of the injector assembly is positioned in the upstream end of the main passage for injecting fuel and oxidizer towards and into the downstream end of the main passage. The upstream section surrounds the injection end of the injector assembly. The downstream section terminates in a main injection opening in the hot face of the block.

According to the invention, the burner block also comprises multiple auxiliary passages intended for transporting an agitating gas through the burner block and for injecting n agitating gas jets into the downstream end of the main passage, with n at least equal to 2. The multiple auxiliary passages terminate in the downstream section of the passage through n auxiliary openings positioned in the surrounding surface of the main passage. The multiple auxiliary passages are more specifically positioned and oriented so that, when the burner is in operation, the n agitating gas jets which are injected via said n auxiliary openings impact the main fuel and the main oxidizer injected by the injector assembly inside or directly downstream of the downstream section.

When the impact does not take place inside the downstream section of the passage, said impact is considered to have taken place immediately downstream of said downstream section when it takes place within a distance from the main injection opening (measured in direction X) which is at most equal to the diameter D of the main injection opening, preferably at most half the diameter D and more preferably at most a quarter of diameter D.

The n auxiliary openings of said multiple auxiliary passages are preferably positioned in axial symmetry around the axis, i.e. the n auxiliary openings are evenly distributed around the axis so as to maximize the impact of the n agitating gas jets with the flows of main fuel and main oxidizer, for example six auxiliary openings at 60° interval around the longitudinal axis.

The multiple auxiliary passages and the n auxiliary openings may be positioned and oriented so as to inject n agitating gas jets in a direction towards the axis.

The multiple auxiliary passages and the n auxiliary openings may also be positioned and oriented so as to inject n agitating gas jets with a same sense of rotation around the axis, for example clockwise or counterclockwise, in order to generate or reinforce a swirling movement of the main fuel and the main oxidizer around the axis. In these cases and in order to enhance the momentum reducing effects of the agitating gas jets, the multiple auxiliary passages and the n auxiliary openings are preferably positioned and oriented so as that the n agitating gas jets are injected according to an injection direction having a vector component towards the axis (as opposed to an injection direction perpendicular to the plane defined by the axis and the corresponding auxiliary opening).

It is preferred for the multiple auxiliary passages and the n auxiliary openings to be positioned and oriented for the injection of the n agitating gas jets according to injection directions which form an angle between 30° and 105° with the main injection direction X, usefully between 45° and 105°.

For certain applications, it is preferred for the multiple auxiliary passages and the n auxiliary openings to be positioned and oriented for the injection of the n agitating gas jets according to injection directions which form an angle of between 60° and 105° with the main injection direction X, preferably between 65° and 85°.

The refractory block may be ceramic or a metallic refractory ceramic block. Further embodiments of the burner according to the invention include one or a combination of the optional features of the burner as described hereinabove with respect to the combustion process of the invention.

The present invention also relates to the use of a method and the burner in a furnace and to a furnace adapted for use in the above-described method.

Such a furnace comprises a burner according to one of the embodiments described above. Said burner is mounted in a furnace wall so that the hot face of the burner block faces a combustion zone of the furnace and so that the cold face of the burner block faces away from the combustion zone. When a flow of main fuel and a flow of main oxidizer are injected by means of the injection end of the main injector assembly towards and into the downstream end of the main passage, combustion of the main fuel with the main oxidizer takes place in the combustion zone of the furnace, whereby, depending on the process, said combustion may be complete or partial.

The furnace may, for example, be a glass or metal melting furnace, a boiler, a gasification furnace, etc.

The multiple auxiliary passages and the n auxiliary openings in the burner block of the burner, and the injection of n agitating gas jets through same, makes it possible to improve the mixing of the main fuel with the main oxidizer and to control flame length and main fuel residence time while shielding the at least one metallic injector from the high temperature in and from heat radiation from the combustion zone, while limiting or avoiding recirculation of the combustion atmosphere into the burner block.

The present invention is hereafter illustrated with reference to the attached figures, whereby:

DETAILED DESCRIPTION OF THE INVENTION

Figure 1:
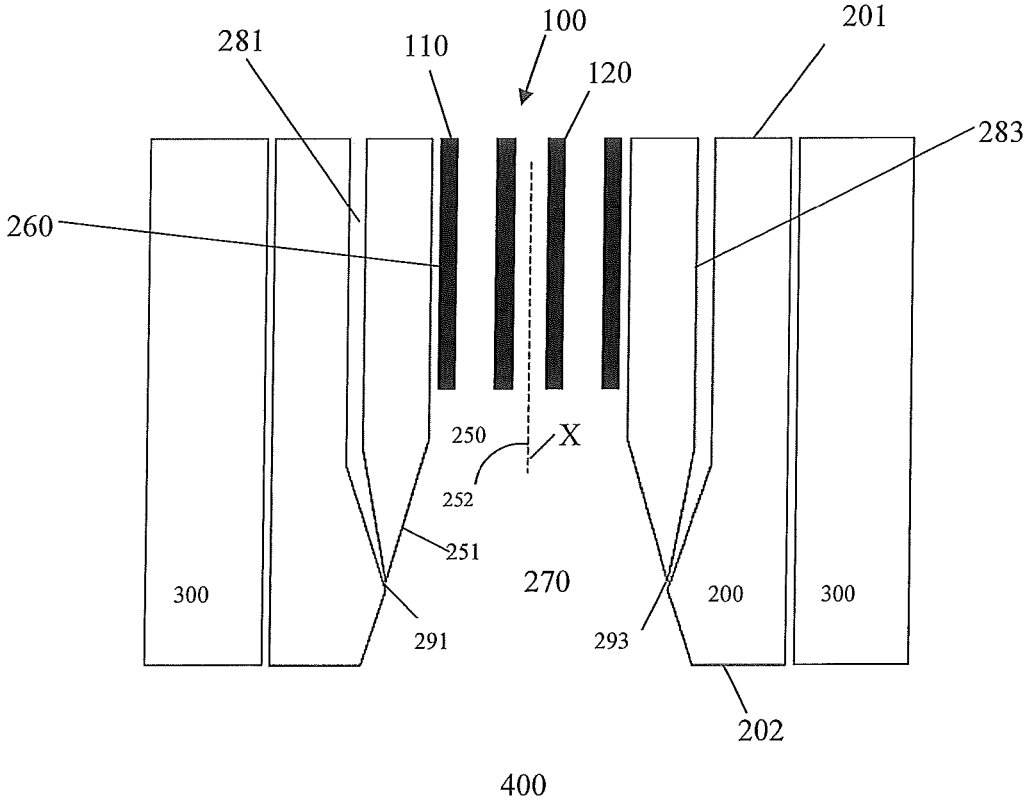
FIG. 1 is a schematic representation of a partial cross section of a burner according to the invention and FIG. 2 is a schematic hot-side front view of the burner of FIG. 1.

The illustrated burners comprise a main injector assembly of which the injection end 100 is shown.

The injection end 100 comprises a central metallic oxidizer injector 120 for the injection of industrially pure oxygen (at least 90% vol $O_2$) mixed with recycled flue gas as the main oxidizer and a surrounding metallic fuel injector 110 for the injection of a gas-entrained particulate solid fuel as the main fuel.

Various conveyor gases may be used for the particulate solid fuel, such as, for example, air, steam or recycled flue gas, with or without oxygen enrichment.

The burners also comprise a refractory block 200, metallic or ceramic, which is mounted in furnace wall 300. A main passage 250, extending along axis 252, is provided through said burner block 200 from the cold face 201 to the hot face 202 of the block 200. The hot face 202 faces the combustion zone 400 of the furnace. Refractory surrounding surface 251 borders the main passage 250 as it traverses block 200.

The main passage has an upstream section 260 adjacent the cold face 201 and a downstream section 270 downstream (in the flow direction of the main fuel and the main oxidizer) of the upstream section 260 and adjacent the hot face 202.

The injection end 100 of the main injector assembly is positioned in the upstream section of the main passage 250 so that the upstream section 260 surrounds the metallic injectors 110, 120.

In use, a flow of the gas-entrained particulate solid fuel and a flow of the main oxidizer are injected towards and into the downstream section 270 of the main passage 250 by means of the injection end 100 of the main injector assembly, so that the two flows come into contact and mix in said downstream section 270.

Figure 2:
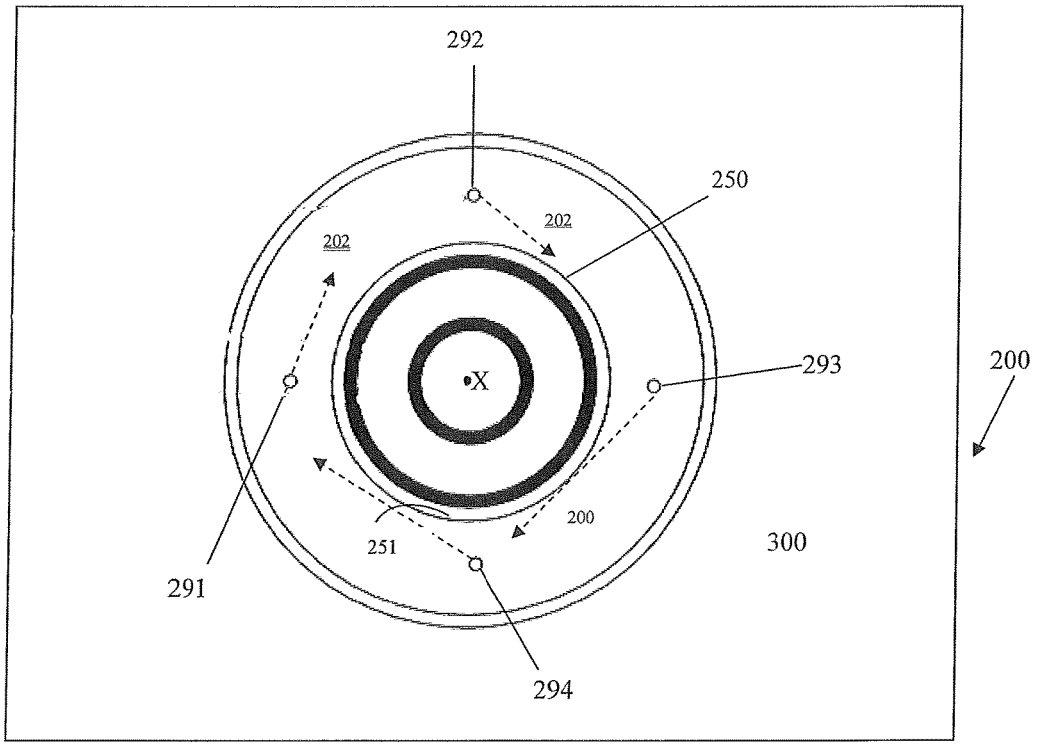

In the embodiment illustrated in FIGS. 1 and 2, burner block 200 comprises four auxiliary passages 281, 283. Each of said auxiliary passages terminates in the widening downstream section 270 via an auxiliary opening 291, 292, 293, 294 in the surrounding surface 251 of the main passage 250. The four auxiliary openings are in axial symmetry around the axis 252 defining an angle of 90° between two successive auxiliary openings 291, 292, 293 and 294.

The four auxiliary passages 281, 283 are positioned and oriented so that gas jets injected through the auxiliary openings 291, 292, 293 and 294 into downstream section 270 are injected in a clockwise direction with respect to the axis 252 (as seen from the hot face 202 of the burner block 200).

The four corresponding agitating gas jets have identical velocities and flow rates.

These gas jets impact the flows of fuel and oxidizer injected by the injection end 100 of the main injection assembly and act as agitating gas jets, increasing the turbulence and mixing of said fuel and oxidizer flows. The agitating gas jets more particularly confer a swirling effect to the main fuel and main oxidizer flows, thereby extending the residence time of the particulate solid fuel in the main oxidizer flow. In the present example, gaseous fuel is injected as agitating gas jet and thus also ensures ignition of the combustion of the main fuel with the main oxidizer. Due to the identical velocities and flow rates of the agitating gas jets, the propagation direction of the flame remains unchanged.

The illustrated burners are self-cooled burners, whereby the burners, and in particular the metallic injectors 110, 120 of the burners, are cooled by the media flowing through same. No additional cooling circuit is provided or necessary in view of the heat screening of the metallic injectors 110, 120, by the burner 200.

In the embodiment illustrated in FIGS. 1 and 2, the downstream section 270 of the main passage 250 has a larger cross section than the upstream section 260 and has a funnel shape widening towards the hot face 202, in order to limit impact of the main fuel and the main oxidizer flows and of the resulting flame when the root of the flame is located within the passage on the refractory surface in the downstream section 270.

The four auxiliary passages 281, 283 are positioned and oriented so that gas jets injected through the auxiliary openings 291, 292, 293 and 294 are injected in a clockwise direction with respect to the axis 252 (as seen from the hot face 202 of the burner block 200), but with a vector component towards axis 252, and so that the agitating gas jets injected through said auxiliary openings 291 to 294 impact the flows of main fuel and main oxidizer within the downstream section 270 of the main passage 250.

Figure 3:
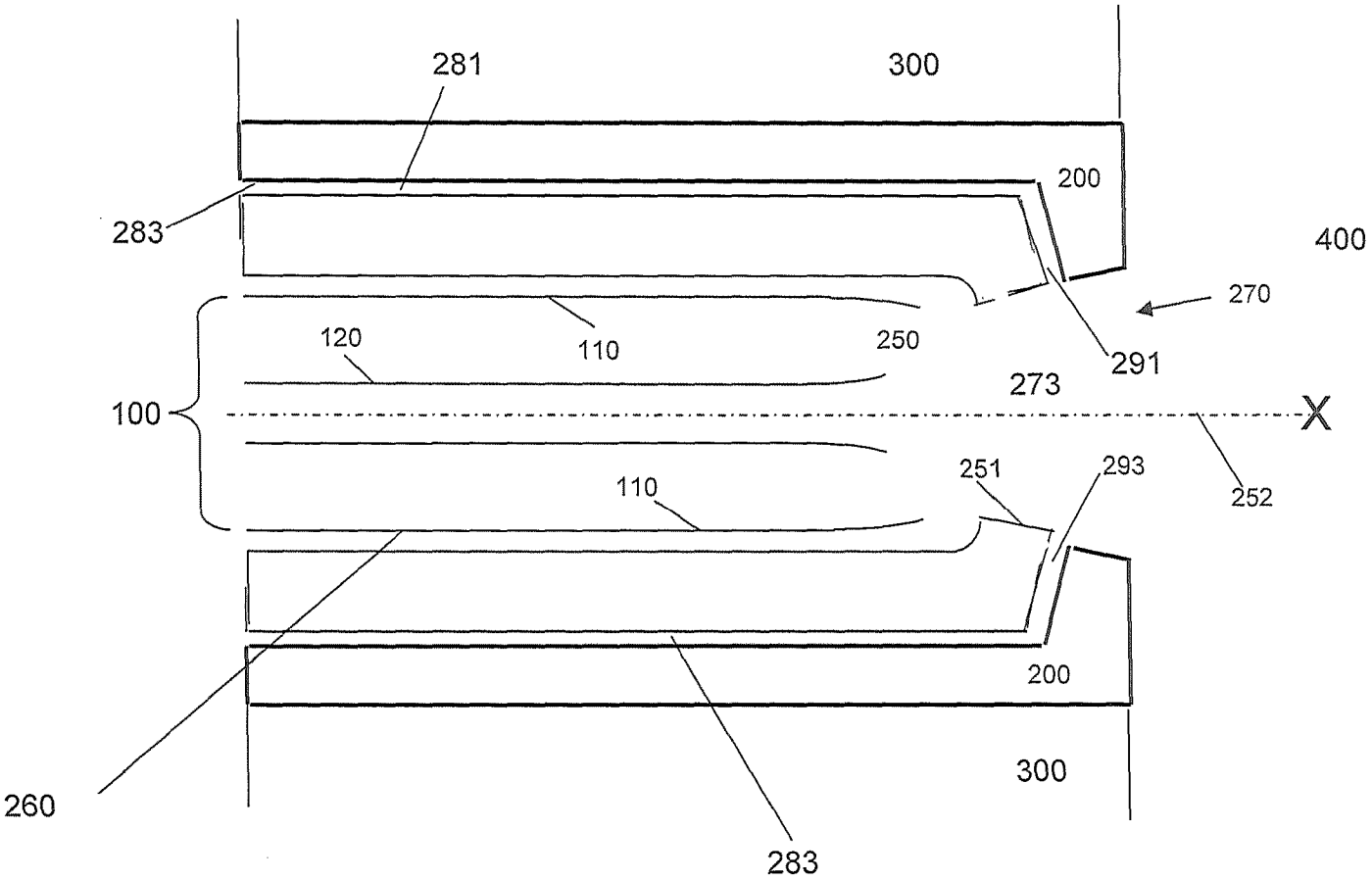
FIG. 3 is a schematic representation of a partial cross section of an alternative embodiment of the burner according to the invention and FIG. 4 is a schematic hot-side front view of the burner of FIG. 3.
Figure 4:
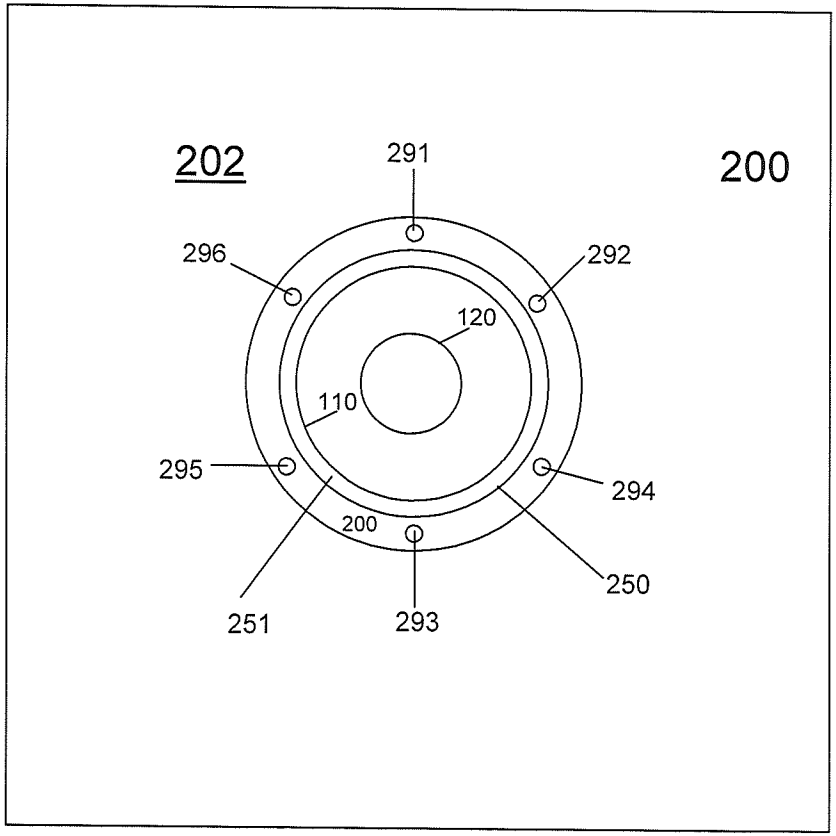

In the embodiment illustrated in FIGS. 3 and 4, the downstream section 270 of the main passage 250 initially has the same cross section as the upstream section 260, then narrows towards the hot face 202, i.e. towards the combustion zone of the furnace, and terminates in a neck portion 273. This neck portion 273 restricts the amount of radiation and combustion gases from the combustion zone which can penetrate into the main passage 250.

As a consequence, condensable substances from the furnace atmosphere are prevented from reaching the cooler injectors.

Burner block 200 comprises six auxiliary passages 281, 283. Each of said auxiliary passages terminates in the neck portion 273 of section 270 via an auxiliary opening 291, 292, 293, 294, 295, 296 in the surrounding surface 251 of the main passage 250. The six auxiliary openings are in axial symmetry around the axis 252 defining an angle of 60° between two successive auxiliary openings 291, 292, 295, 293, 294, 296.

The six auxiliary passages 281, 283 are positioned and oriented so that the agitating gas jets injected through the auxiliary openings 291 to 296 are injected in a counterclockwise direction with respect to the axis 252 (as seen from the hot face 202 of the burner block 200) impact the flows of main fuel and main oxidizer essentially at or immediately upstream or downstream of the main injection opening of main passage 250.

Due to the orientation of the agitating gas jets, no swirling devices are necessary to ensure a sufficiently long residence time of the particulate fuel in the main oxidizer flow while simultaneously the solid angle of the flow of gas-entrained solid fuel and main oxidizer remains small. In this manner, adequate mixing of the fuel and main oxidizer is achieved. If, in order to increase the swirling effect, the burner is also equipped with a mixing device as described above, the mixing device is preferably located within or immediately downstream of the main oxidizer injector 120 to avoid erosion of said swirling device due to impact by the particulate solid fuel.

While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims. The present invention may suitably comprise, consist or consist essentially of the elements disclosed and may be practiced in the absence of an element not disclosed. Furthermore, if there is language referring to order, such as first and second, it should be understood in an exemplary sense and not in a limiting sense. For example, it can be recognized by those skilled in the art that certain steps can be combined into a single step.

The singular forms "a", "an" and "the" include plural referents, unless the context clearly dictates otherwise.

"Comprising" in a claim is an open transitional term which means the subsequently identified claim elements are a nonexclusive listing i.e. anything else may be additionally included and remain within the scope of "comprising." "Comprising" is defined herein as necessarily encompassing the more limited transitional terms "consisting essentially of" and "consisting of; "comprising" may therefore be replaced by "consisting essentially of" or "consisting of" and remain within the expressly defined scope of "comprising".

"Providing" in a claim is defined to mean furnishing, supplying, making available, or preparing something. The step may be performed by any actor in the absence of express language in the claim to the contrary.

Optional or optionally means that the subsequently described event or circumstances may or may not occur. The description includes instances where the event or circumstance occurs and instances where it does not occur.

Ranges may be expressed herein as from about one particular value, and/or to about another particular value. When such a range is expressed, it is to be understood that another embodiment is from the one particular value and/or to the other particular value, along with all combinations within said range.

All references identified herein are each hereby incorporated by reference into this application in their entireties, as well as for the specific information for which each is cited.

What is claimed is:

1. A method of combusting fuel with oxidizer by means of a burner comprising a main injector assembly and a refractory burner block, whereby the main injector assembly terminates in an injection end which comprises at least one metallic injector, the block comprises a main passage bordered by a surrounding passage surface and extending along an axis from a cold face of the block to a hot face of the block opposite the cold face, the main passage defines a main injection direction X parallel to the axis and has an upstream section adjacent the cold face and a downstream section downstream of the upstream section and adjacent the hot face, said downstream section terminating in a main injection opening in the hot face of the block, and the injection end of the main injector assembly is positioned in the upstream section of the main passage so that the upstream section surrounds the at least one metallic injector, a flow of main fuel and flow of main oxidizer are injected according to main injection direction X towards and into the downstream section of the main passage by means of the injector end of the main injector assembly, characterized in that:

the burner block further comprises multiple auxiliary passages terminating in the downstream section via n auxiliary openings in the surrounding surface of the main passage, whereby n≥2 and n jets of agitating gas are injected into the downstream section via the n auxiliary openings so as to interact with the flow of main fuel and the flow of main oxidizer and to increase turbulence and mixing thereof.

2. The method of claim 1, whereby the n jets of agitating gas are injected so as to decrease the momentum of the flow of main fuel and the flow of main oxidizer in the main injection direction X.

3. The method of claim 1, whereby the n auxiliary openings are positioned in axial symmetry around the axis.

4. The method of claim 1, whereby:

the n agitating gas jets are directed towards the axis, or the n agitating gas jets are injected according to a same sense of rotation around the axis.

5. The method of claim 1, whereby the agitating gas jets are injected according to an injection direction forming an angle of between 30° and 105° with the main injection direction X, preferably between 45° and 105° , more preferably between 45° and 105°, and most preferably between 65° and 85°.

6. The method of claim 1, whereby the refractory block is a refractory ceramic block or a refractory metallic block.

7. The method of claim 1, whereby the agitating gas is selected from: a substantially inert gas, a secondary oxidizer and a secondary gaseous fuel.

8. The method of claim 1 whereby:

at least part of the main fuel is injected around the main oxidizer, or least part of the main oxidizer is injected around the main fuel.

9. A burner comprising a metallic injector assembly and a refractory burner block, the injector assembly comprising an injection end and terminating in at least one metallic injector, the block comprising a main passage bordered by a surrounding surface and extending along an axis from a cold face of the block to a hot face of the block opposite the cold face, the main passage having a longitudinal axis, an upstream section adjacent the cold face and a downstream section adjacent the hot face and downstream of the upstream section, said downstream section terminating in a main injection opening in the hot face of the block, the injection end of the injector assembly being positioned in the upstream section of the main passage for injecting fuel and oxidizer towards and into the downstream section of the main passage said upstream section surrounding the at least one metallic injector, characterized in that:

the burner block further comprises multiple auxiliary passages for transporting an agitating gas through the burner block and for injecting agitating gas jets into the downstream section of the main passage, the multiple auxiliary passages terminating in the downstream section of the passage through n auxiliary openings in the surrounding surface of the main passage, with n≥2, the multiple auxiliary passages being positioned and oriented so that, in operation, the n agitating gas jets injected via said n auxiliary openings interact with the main fuel and the main oxidizer injected by the injector assembly inside or downstream of the downstream section so as to generate increased turbulence and mixing of the main fuel with the main oxidizer.

10. The burner of claim 9, whereby the n auxiliary openings are evenly distributed around the longitudinal axis.

11. The burner of claim 9, whereby the multiple auxiliary passages are positioned and oriented so that, in operation, the n agitating gas jets are injected via said n auxiliary openings:

with injection directions directed towards the longitudinal axis, or with injection directions presenting a same sense of rotation around the axis.

12. The burner of claim 9, whereby the multiple auxiliary passages are positioned and oriented so that, in operation, the n agitating gas jets are injected via said n auxiliary openings with injection directions forming an angle of between 30° and 105° with the main injection direction X, preferably between 45° and 105°, more preferably between 60° and 105°, and most preferably between 65° and 85°.

13. The burner of claim 9, whereby the injection end of the injector assembly comprises an oxidizer injector and a fuel injector, whereby the injection end of the injector assembly preferably comprises (a) an oxidizer injector which surrounds a fuel injector or (b) a fuel injector which surrounds an oxidizer injector.

14. The burner of claim 9, whereby the refractory block is a refractory ceramic block or a refractory metallic block.

15. The furnace comprising at least one burner of claim 9, said burner being mounted in a furnace wall so that the hot face of the burner block faces a combustion zone of the furnace and so that the cold face of the burner block faces away from the combustion zone.

* * * * *